US008713936B2

(12) United States Patent
Joergl

(10) Patent No.: US 8,713,936 B2
(45) Date of Patent: May 6, 2014

(54) MULTI-FUNCTIONAL VALVE FOR USE IN AN EXHAUST BREATHING SYSTEM

(75) Inventor: Volker Joergl, Ortonville, MI (US)

(73) Assignee: BorgWarner Inc., Auburn Hills, MI (US)

( * ) Notice: Subject to any disclaimer, the term of this patent is extended or adjusted under 35 U.S.C. 154(b) by 783 days.

(21) Appl. No.: 12/374,809

(22) PCT Filed: Aug. 3, 2007

(86) PCT No.: PCT/US2007/075200
§ 371 (c)(1),
(2), (4) Date: Jan. 23, 2009

(87) PCT Pub. No.: WO2008/024609
PCT Pub. Date: Feb. 28, 2008

(65) Prior Publication Data

US 2009/0183509 A1 Jul. 23, 2009

Related U.S. Application Data

(60) Provisional application No. 60/835,741, filed on Aug. 4, 2006.

(51) Int. Cl.
*F02B 33/44* (2006.01)

(52) U.S. Cl.
USPC ..... 60/605.2; 123/568.12; 123/568.24; 137/872; 137/876; 251/208

(58) Field of Classification Search
CPC ..... F02B 33/44
USPC ..... 60/605.2; 123/568.12, 568.24; 137/872, 137/876; 251/208
See application file for complete search history.

(56) References Cited

U.S. PATENT DOCUMENTS

| | | | | |
|---|---|---|---|---|
| 4,554,942 | A * | 11/1985 | Williams et al. | 137/240 |
| 5,190,077 | A * | 3/1993 | Pawelzik et al. | 137/625.46 |
| 6,000,222 | A * | 12/1999 | Regnier | 60/605.2 |
| 6,135,152 | A * | 10/2000 | Knapp | 137/625.41 |
| 6,378,509 | B1 * | 4/2002 | Feucht et al. | 60/605.2 |
| 7,213,587 | B2 * | 5/2007 | Rutten | 123/568.24 |
| 2006/0021346 | A1 * | 2/2006 | Whelan et al. | 60/605.2 |
| 2006/0236693 | A1 * | 10/2006 | Wei et al. | 60/605.2 |

FOREIGN PATENT DOCUMENTS

| | | |
|---|---|---|
| DE | 10222919 | 12/2003 |
| GB | 2416565 | 2/2006 |
| WO | 0042305 A1 | 7/2000 |

OTHER PUBLICATIONS

PCT/US2007/075200 Written Opinion and Search Report; Forms PCT/ISA/237, PCT/ISA/210; Mailed Jan. 15, 2008; 7 pages.
Supplementary Partial European Search Report, Application No. EP 07 84 0683, dated Oct. 26, 2011, 6 pages.

* cited by examiner

*Primary Examiner* — Tran Nguyen
*Assistant Examiner* — Michael Andrews
(74) *Attorney, Agent, or Firm* — BrooksGroup

(57) ABSTRACT

One embodiment includes a housing (12) and a valve (10) to be used in an internal combustion engine exhaust breathing system (14). The housing (12) may define one or more inlet passages that receive fluid-flow, and may also define one or more outlet passages that deliver fluid-flow. The valve (10) regulates fluid-flow through the housing (12) and between the passages.

55 Claims, 5 Drawing Sheets

MULTI-FUNCTIONAL VALVE FOR USE IN AN EXHAUST BREATHING SYSTEM

CROSS REFERENCE TO RELATED APPLICATIONS

This application claims the benefit of U.S. Provisional Patent Application Ser. No. 60/835,741 filed Aug. 4, 2006.

TECHNICAL FIELD

The field to which the disclosure generally relates includes products including a valve to regulate fluid-flow in an internal combustion engine exhaust breathing system.

BACKGROUND

Internal combustion engines, like diesel engines, are often equipped with exhaust breathing systems to, among other things, decrease emissions and increase engine efficiency. Such systems may include an exhaust gas recirculation assembly, a turbocharger, a diesel particulate filter, and other components. Valves and passages are commonly located throughout the system to regulate fluid-flow between the components.

SUMMARY OF EXEMPLARY EMBODIMENTS OF THE INVENTION

One embodiment of the invention includes a product comprising a housing, a valve, and an actuator. The housing may be disposed in an internal combustion engine exhaust breathing system; and may define an inlet passage, a first outlet passage leading to a first exhaust breathing system component, a second outlet passage leading to a second exhaust breathing system component, and a third outlet passage leading to a third exhaust breathing system component. The valve may regulate fluid-flow through the housing, and between the outlet passages. And the actuator may operate the valve.

Another embodiment of the invention includes a product comprising a housing and a valve. The housing may be constructed for use in an exhaust breathing system of an internal combustion engine. The housing may define an inlet passage, a first outlet passage, a second outlet passage, and a third outlet passage. The valve may regulate fluid-flow between the inlet passage and the outlet passages.

Another embodiment of the invention includes a product comprising an exhaust breathing system for an internal combustion engine. The exhaust breathing system may comprise an exhaust manifold, an exhaust gas recirculation assembly, a turbine, and a turbine bypass. The product also may comprise a housing that defines an inlet passage from the exhaust manifold, defines a first outlet passage to the exhaust gas recirculation assembly, defines a second outlet passage to the turbine, and defines a third outlet passage to the turbine bypass. The valve may regulate fluid-flow between the inlet passage and the outlet passages. And the actuator may operate the valve.

Another embodiment of the invention includes a product comprising a housing and a valve. The housing may be constructed for use in an internal combustion engine exhaust breathing system. The housing may define an inlet passage and a first and second outlet passage. The valve may be disposed within the housing and may be located upstream the first and second outlet passages. The valve may regulate fluid-flow between the inlet passage and the outlet passages, and the valve may comprise a substrate and a disc. The substrate may define a first cutout and a second cutout, and the substrate may define a fourth cutout and a fifth cutout. The disc may rotate with respect to the substrate to align and misalign the cutouts, and thus to regulate fluid-flow between the passages.

Another embodiment of the invention includes a product comprising a housing and a valve. The housing may be constructed for use in an internal combustion engine exhaust breathing system. The housing may define a first inlet passage, a second inlet passage, and a first outlet passage. The valve may be disposed within the housing and may be located downstream the first and second inlet passages. The valve may regulate fluid-flow between the inlet passages and the outlet passage, and the valve may comprise a substrate and a disc. The substrate may define a first cutout and a second cutout, and the substrate may define a fourth cutout and a fifth cutout. The disc may rotate with respect to the substrate to align and misalign the cutouts, and thus to regulate fluid-flow between the passages.

Other exemplary embodiments of the present invention will become apparent from the detailed description provided hereinafter. It should be understood that the detailed description and specific examples, while disclosing exemplary embodiments of the invention, are intended for purposes of illustration only and are not intended to limit the scope of the invention.

BRIEF DESCRIPTION OF THE DRAWINGS

Exemplary embodiments of the present invention will become more fully understood from the detailed description and the accompanying drawings, wherein.

DETAILED DESCRIPTION OF EXEMPLARY EMBODIMENTS

Figure 1:
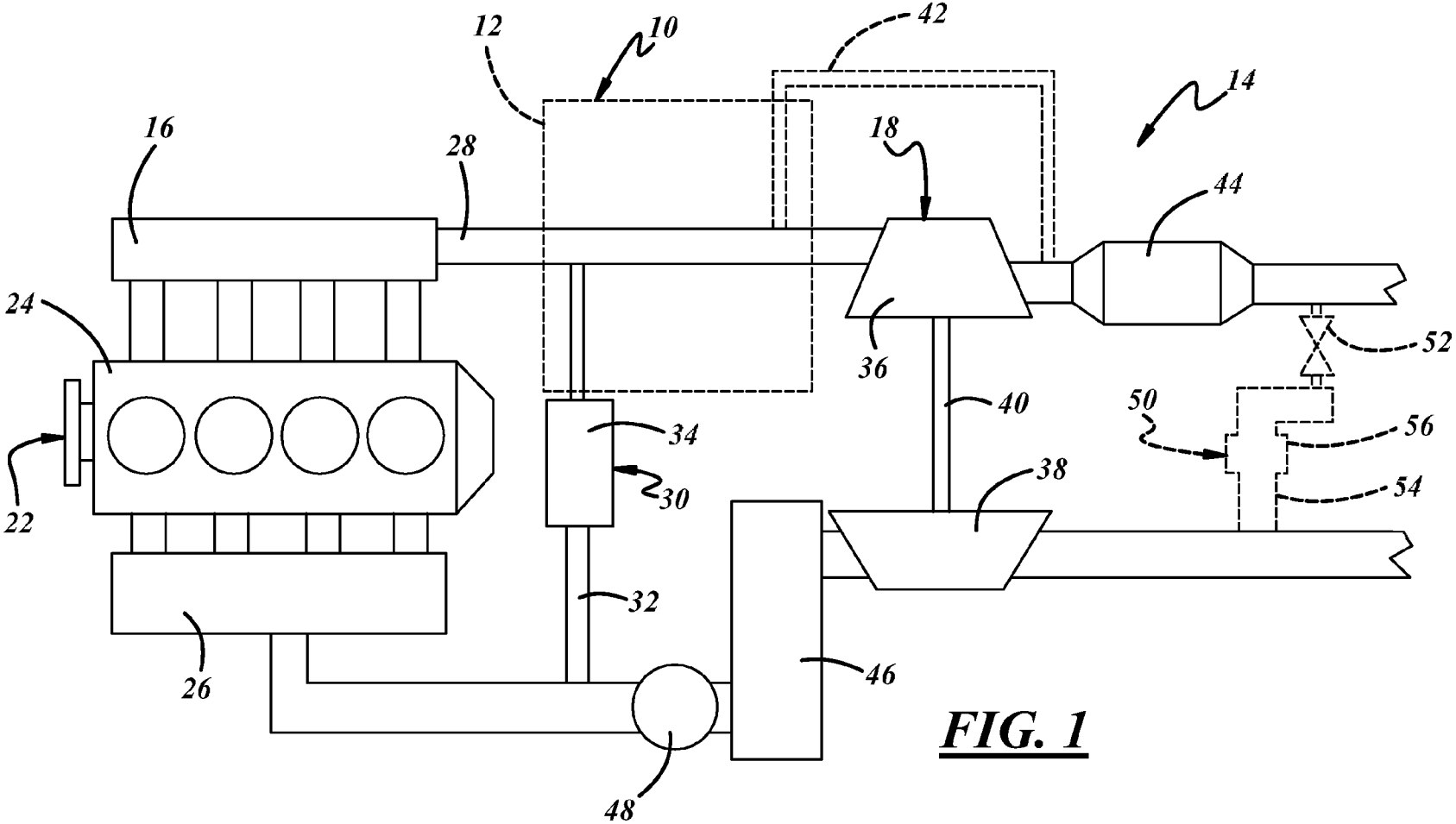
FIG. 1 illustrates a schematic of an embodiment of an internal combustion engine exhaust breathing system that includes a valve.

The following description of the embodiment(s) is merely exemplary in nature and is in no way intended to limit the invention, its application, or uses.

Referring now to FIGS. 2-4*e*, several embodiments of the invention include a product that may be a valve 10 disposed within a housing 12 for use in an internal combustion engine exhaust breathing system 14. In some embodiments, the valve 10 may be designed to be installed in the exhaust breathing system 14 downstream an exhaust manifold 16 and upstream an exhaust breathing system component such as a turbocharger 18. In this example location, the valve 10 may regulate fluid-flow, particularly exhaust emissions, between the exhaust manifold 16 and various exhaust breathing system components, and may use a single actuator 20. The example location may reduce pressure on the turbocharger 18 as compared to an exhaust breathing system with a valve installed downstream the turbocharger; and in some cases the single actuator 20 may make the exhaust breathing system 14 less complex as compared to an exhaust breathing system with more than one actuator. Of course, other locations are possible which may improve the exhaust breathing system 14 in other ways.

Referring to FIG. 1, an internal combustion engine 22 may be a spark-ignited engine or a diesel engine. The example shown is a diesel engine that may be of different types having different arrangements and numbers of cylinders (e.g., in-line, V-type, V-6, etc.). Although not shown, typical diesel engines may include, among various components, a crankcase to house and support a crankshaft assembly, and an oil pan mounted underneath the crankcase to collect engine oil. A cylinder block 24 may be mounted on top of the crankcase and may define a plurality of piston bores or cylinders. The exhaust manifold 16 may be equipped on an exhaust side of the internal combustion engine 22 to direct fluid-flow, such as emissions, exhaled from the engine and to the exhaust breathing system 14. An intake manifold 26 may be equipped on an opposite side, or an intake side, of the internal combustion engine 22 to direct and supply air or air-fuel mixture to the engine.

The diesel engine may also be equipped with the exhaust breathing system 14 to manage fluid-flow discharged out of the internal combustion engine 22 and that, in some cases, can decrease engine emissions and increase engine efficiency. The engine exhaust breathing system 14 may come in various arrangements and have various components. The example shown in FIG. 1 may include a passage 28 piped from the exhaust manifold 16, and may include components such as an exhaust gas recirculation (EGR) assembly 30, and the turbocharger 18.

The EGR assembly 30 may be a high pressure assembly that recirculates a certain amount of inert emissions, such as nitrogen oxides, back into the intake manifold 26. This can lower the combustion temperature of the internal combustion engine 22. The EGR assembly 30 may communicate the exhaust manifold 16 with the intake manifold 26. One example of the EGR assembly 30 may include an EGR passage 32 permitting fluid-flow between the intake and exhaust sides or manifolds, and an EGR cooler 34 that cools the fluid-flow. The turbocharger 18 may be driven by fluid-flow exiting the internal combustion engine 22 to force an additional amount of air or air-fuel mixture into the engine that may improve engine performance. The turbocharger 18 may be located downstream the exhaust manifold 16 and past the EGR assembly 30. The turbocharger 18 may come in various forms including a fixed geometry turbocharger, a variable geometry turbocharger, a one-stage turbocharger, a two-stage turbocharger, and the like. One example of the turbocharger 18 may include a turbine 36 that may be directly driven by the engine fluid-flow and that in turn may drive a compressor 38 through a shared shaft 40. The compressor 38 compresses air entering the intake manifold 26. The turbocharger 18 may also include a turbine bypass 42 (shown in phantom), or a wastegate, that may be opened to prevent "overboost" by the turbocharger. The turbine bypass 42 may be set such that when the engine intake pressure reaches a predetermined pressure, fluid-flow is diverted around the turbine 36.

Still referring to FIG. 1, in this example the exhaust breathing system 14 may also include other components including a diesel particulate filter (DPF) 44 that removes diesel particulate matter, or soot, from the fluid coming out of the diesel engine. The DPF 44 may be located downstream the turbine 36. A charge-air cooler 46 may be located downstream the compressor 38 on the intake side of the internal combustion engine 22. The charge-air cooler 46 can cool air coming out of the compressor 38 and thus increase its density. An intake throttle valve 48 may be located downstream the charge-air cooler 46 on the intake side. The throttle valve 48 may regulate the flow of air or air-fuel mixture to the internal combustion engine 22. The exhaust breathing system 14 may also include a low pressure exhaust gas recirculation (EGR) assembly 50 (shown in phantom) that recirculates fluid back to the intake side. The EGR assembly 50 may be located downstream the DPF 44 on the exhaust side of the internal combustion engine 22, and upstream the compressor 38 on the intake side; it may also communicate the exhaust and intake sides thereat. The EGR assembly 50 may include an EGR valve 52 that regulates fluid-flow through an EGR passage 54 and into an EGR cooler 56.

Figure 2:
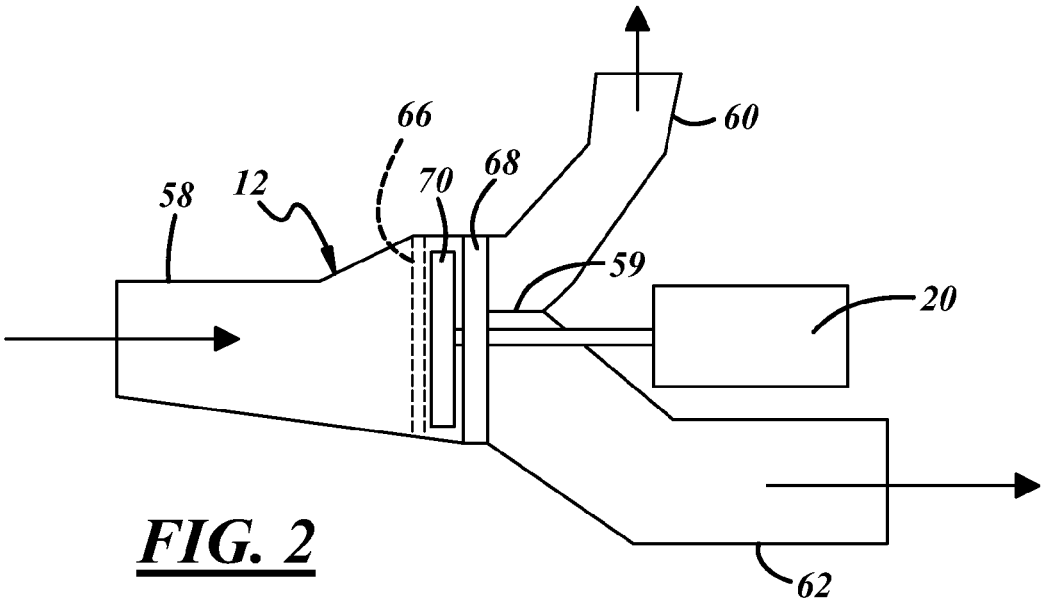
FIG. 2 illustrates a schematic of an embodiment of a valve disposed within a housing.
Figure 3:
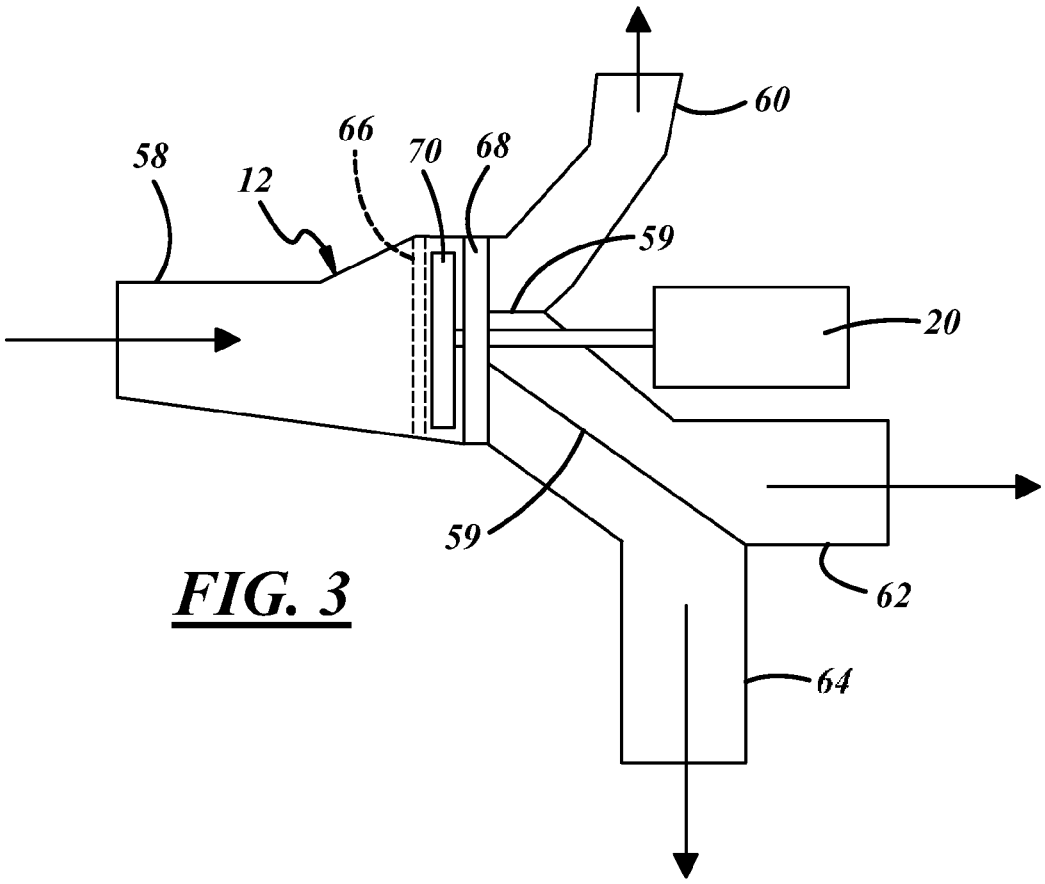
FIG. 3 illustrates a schematic of an embodiment of a valve disposed within a housing.

FIGS. 2 and 3 show a pair of embodiments of the housing 12. The housing 12 may house and support the valve 10. The housing 12 may be made out of a suitable material that is impervious to emissions; and may be a separate part that is retrofitted in the exhaust breathing system 14, or may be part of, or integral with, the original equipment of the exhaust breathing system 14. As one example, the housing 12 may be located in the exhaust breathing system 14 downstream the exhaust manifold 16, and upstream the EGR assembly 30 and the turbocharger 18 (see FIG. 1). The housing 12 may also be located in various positions in the exhaust breathing system 14; for instance, the example embodiment of FIG. 3 may be located anywhere that the inlet passage may receive fluid-flow and the three outlet passages could thus deliver the fluid-flow to exhaust breathing system components. Referring to the examples shown, the housing 12 may define an inlet passage 58 that may lead directly from the exhaust manifold 16 and may receive fluid-flow directly from the exhaust manifold. In this sense, the word "directly" means having no substantial intervening components such as exhaust breathing system components, other than passages, sensors, and the like. In other words, for the example shown, fluid may flow from the exhaust manifold 16 and to the inlet passage 58 virtually uninterrupted. Though shown separate, the inlet passage 58 may be part of, or integral with, the exhaust manifold 16. The housing 12 may also include one or more baffles 59 lined on the inside of the housing to partition the various outlet passages.

The example embodiment of FIG. 2 shows the housing 12 defining a pair of outlet passages. The housing 12 may define a first outlet passage 60 that may lead directly to a first exhaust breathing system component such as, but not limited to, the EGR assembly 30, and may deliver fluid-flow directly to the EGR assembly 30. Though shown separate, the first outlet passage 60 may be part of, or integral with, the EGR assembly 30. The housing 12 may also define a second outlet passage 62 that may lead directly to a second exhaust breathing system component such as, but not limited to, the turbocharger 18 (particularly the turbine 36), and may deliver fluid-flow directly to the turbocharger 18 (turbine 36). Though shown separate, the second outlet passage 62 may be part of, or integral with, the turbocharger 18. In other embodiments, the housing 12 may define a second inlet passage in addition to the inlet passage 58, and may also define a single outlet passage. In this embodiment, the inlet passages may receive fluid-flow from exhaust breathing system components and deliver the fluid-flow out the outlet passage. This embodiment may be used with the valve 10 of FIG. 4*a*.

The example embodiment of FIG. 3 shows the housing 12 defining a third outlet passage 64 in addition to the first and second outlet passages 60 and 62. The third outlet passage 64 may lead directly to a third exhaust breathing system component such as, but not limited to, the turbine bypass 42, and may deliver fluid-flow directly to the turbine bypass 42.

Some embodiments of the housing 12 may also include one or more built-in cooling passage(s) 66 (shown in phantom). The cooling passage(s) may be used to cool parts of the housing 12 or the valve 10. As shown, the single cooling passage 66 may be integral with a wall of the housing 12 and located near the valve 10. Water or other coolant may pass through the cooling passage 66 to cool the valve 10.

FIGS. 4*a*-4*e* show several example embodiments of the valve 10. Other embodiments may exist that are not necessarily shown or described. The valve 10 may regulate fluid-flow through the housing 12 by permitting (opening) and preventing (closing) fluid-flow through the various outlet passages. The valve 10 may be a single valve that performs similar functions of several separate valves for each outlet passage and exhaust breathing system component. In this sense, the valve 10 is multi-functional. The valve 10 may be located in the housing 12 downstream the inlet passage 58 and upstream the outlet passages.

Figure 4A:
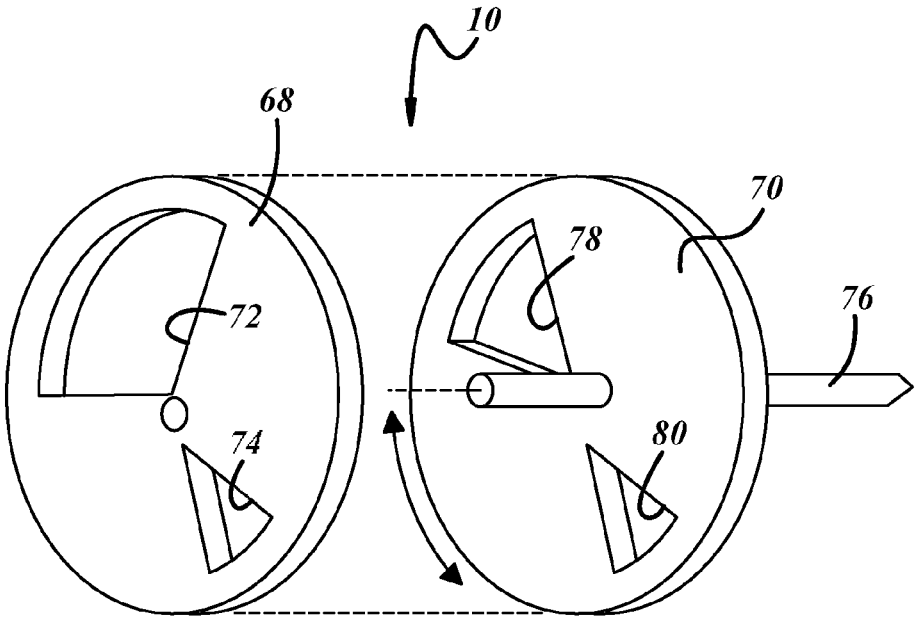
FIG. 4*a* illustrates an exploded view of an embodiment of a valve.

FIG. 4*a* shows one example embodiment of the valve 10 that may include a substrate 68 and a disc 70. The substrate 68 may be fixed stationary inside the housing 12 extending across a direction of fluid-flow in a substantially perpendicular orientation to the direction. The substrate 68 may be fixed in the housing 12 by a variety of ways including by welding, mechanical attachments, press-fitting, and the like. The substrate 68 may also be integral with, or be part of the housing 12, for example, the substrate 68 may be a wall in the housing 12 so that the wall and the housing are a single integral piece and in one embodiment may be a cast metal. The substrate 68 may be shaped complementary to a cross-section of the housing 12—in this case a circle. The substrate 68 may define a first cutout 72 and a second cutout 74. The cutouts may form any shapes permitting fluid-flow therethrough. As shown, the first cutout 72 may have a larger triangular shape than the oppositely located second cutout 74. The disc 70 may be capable of rotating about a pin 76 with respect to the substrate 68 in either a clockwise or a counterclockwise direction. When disposed in the housing 12, the disc 70 may be concentric with a center axis of the substrate 68, may overlap part of the substrate 68, and may be axially offset from the substrate 68. The disc 70 may define a fourth cutout 78 and a fifth cutout 80. The cutouts may form any shapes permitting fluid-flow therethrough. As shown, the fourth cutout 78 may have a larger triangular shape than the oppositely located fifth cutout 80.

When used in the exhaust breathing system 14, the valve 10 may actively regulate fluid-flow through the various outlet passages and thus to the particular exhaust breathing system component. To do so, the valve 10 may continuously adjust its position (opening and closing). For example, the valve 10 of FIG. 4*a* may be equipped in the housing 12 of FIG. 2 to regulate fluid-flow between the first outlet passage 60 to meter fluid-flow to the EGR assembly 30, and the second outlet passage 62 to, among other things, throttle exhaust fluid-flow for engine braking, engine shut-off, or a desired engine exhaust back pressure. The disc 70 may rotate with respect to the substrate 68 to align, partially align, or misalign the cutouts 72, 74, 78, and 80, and thus open, partially close, and close the particular outlet passages. The respective cutouts may be sized and arranged in the substrate 68 and the disc 70 to perform different operations to the outlet passages. In this example, the first cutout 72 may lead to the second outlet passage 62, and the second cutout 74 may lead to the first outlet passage 60. The disc 70 may be rotated in various positions in order to perform various operations including fully opening the first outlet passage 60 and concurrently fully opening the second outlet passage 62. The first outlet passage 60 may be closed, while the second outlet passage 62 may be fully open. The first outlet passage 60 may be partially close, while the second outlet passage 62 may be fully open. The first outlet passage 60 may be closed, while the second outlet passage 62 may also be closed. And the first outlet passage 60 may be closed, while the second outlet passage 62 may be partially close. Other operations may be possible.

Figure 4B:
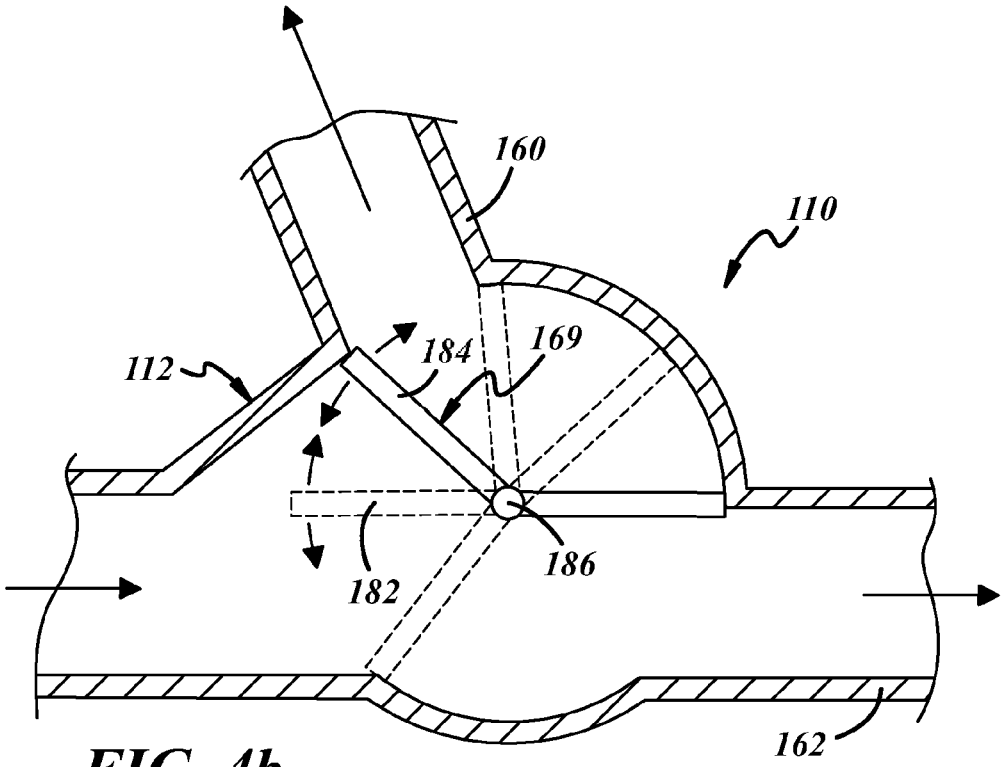
FIG. 4*b* illustrates a sectional of an embodiment of a valve.

FIG. 4*b* shows another example embodiment of a valve 110 that may include a flapper valve 169. The flapper valve 169 may have a first flap 182 and a second flap 184 that move together about an axis 186 to various positions including those shown in phantom. The valve 110 may be equipped in a housing 112 to regulate fluid-flow between a first outlet passage 160 and a second outlet passage 162. The valve 110 may perform similar operations to the valve 10 described in FIG. 4*a*.

Figure 4C:
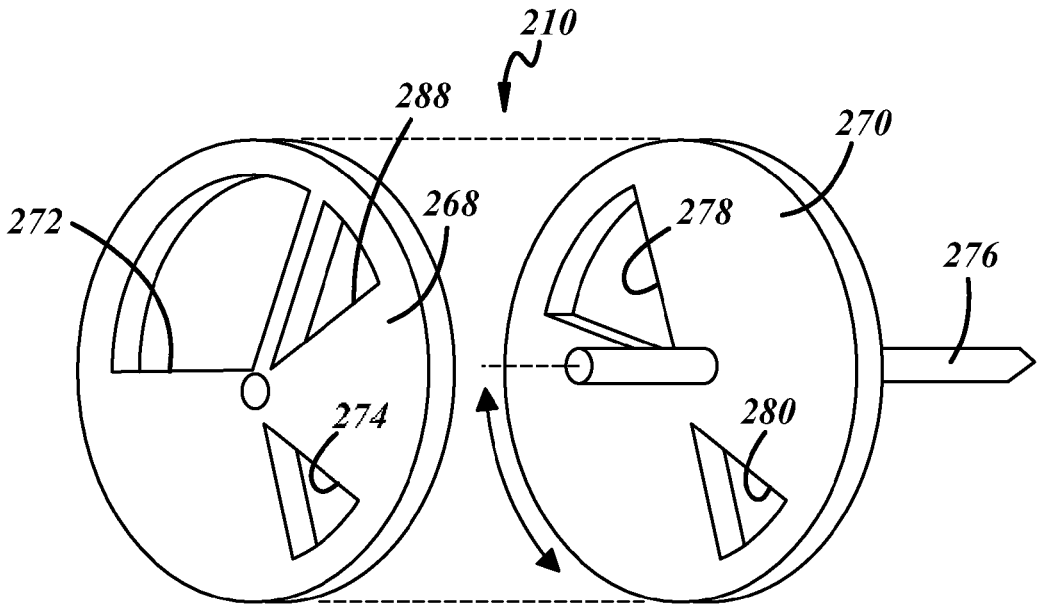
FIG. 4*c* illustrates an exploded view of an embodiment of a valve.

FIG. 4*c* shows another example embodiment of a valve 210 that may include a substrate 268 and a disc 270. The substrate 268 may be similar in some ways to the substrate 68 described in FIG. 4*a*, and may define a first cutout 272 and a second cutout 274. One difference may be a third cutout 288. The third cutout 288 may form any shape permitting fluid-flow therethrough. As shown, the third cutout 288 may have a triangular shape and may be located next to the first cutout 272. The disc 270 may be similar to the disc 70 described in FIG. 4*a*, and may define a fourth cutout 278 and a fifth cutout 280, and may rotate about a pin 276.

When used in the exhaust breathing system 14, the valve 210 may be equipped in the housing 12 of FIG. 3 to regulate fluid-flow between the first outlet passage 60, the second outlet passage 62, and the third outlet passage 64. The disc 270 may rotate with respect to the substrate 268 to align, partially align, or misalign the cutouts 272, 274, 288, 278, and 280, and thus open, partially close, and close the particular outlet passages. The respective cutouts may be sized and arranged in the substrate 268 and the disc 270 to perform different operations to the outlet passages. In this example, the first cutout 272 may lead to the second outlet passage 62, the second cutout 274 may lead to the first outlet passage 60, and the third cutout 288 may lead to the third outlet passage 64. The disc 270 may be rotated in various positions in order to perform various operations including concurrently fully opening the first outlet passage 60, fully opening the second outlet passage 62, and closing the third outlet passage 64. The first outlet passage 60 may be partially close, while the second outlet passage 62 may be fully open, and while the third outlet passage 64 may be closed. The first outlet passage 60 may be closed, while the second outlet passage 62 may be partially close, and while the third outlet passage 64 may be partially close. The first outlet passage 60 may be closed, while the second outlet passage 62 may be closed, and while the third outlet passage 64 may be fully open. The first outlet passage 60 may be closed, while the second outlet passage 62 may be closed, and while the third outlet passage 64 may be closed. Other operations may be possible.

Figure 4D:
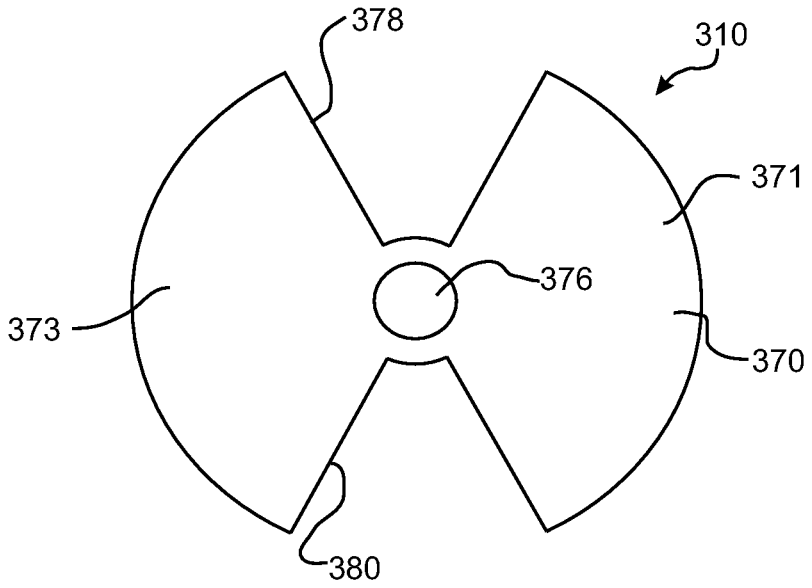
FIG. 4*d* illustrates a plan view of an embodiment of a valve.

FIG. 4*d* shows another example embodiment of a vale 310 that may include a disc 370. The disc 370 may be similar in some ways to the disc 70 described in FIG. 4*a* and may define a fourth cutout 378 and a fifth cutout 380, and may rotate about a pin 376. The disc 370 may also form a first spoke 371 and a second spoke 373. Although not shown, the valve 310 may also include a substrate similar to that described in FIG. 4*c*.

When used in the exhaust breathing system 14, the valve 310 may be equipped in the housing 12 of FIG. 3 to regulate fluid-flow between the first outlet passage 60, the second outlet passage 62, and the third outlet passage 64. The disc 370 may rotate with respect to the associated substrate to align, partially align, or misalign the respective cutouts. This embodiment of the valve may perform similar operations to the embodiment described in FIG. 4*c*, so the operations will not be repeated here.

Figure 4E:
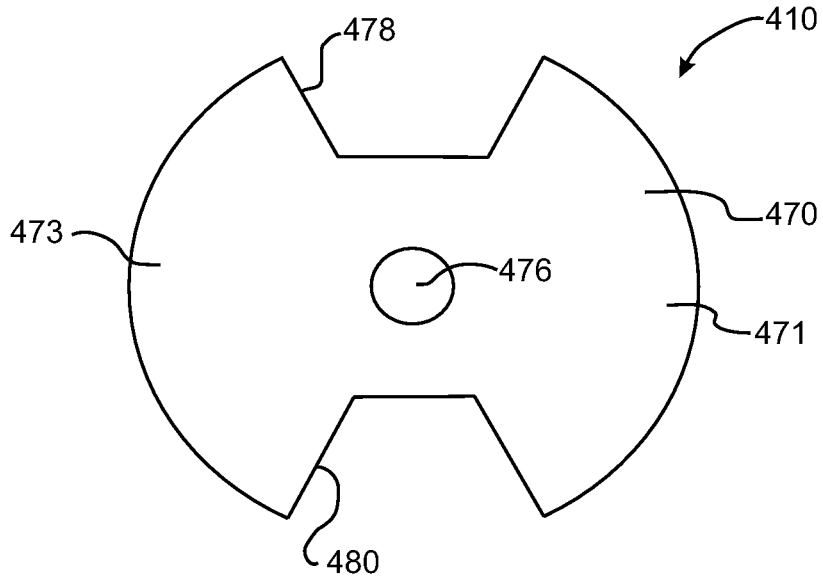
FIG. 4*e* illustrates a plan view of an embodiment of a valve.

FIG. 4*e* shows another example embodiment of a vale 410 that may include a disc 470. The disc 470 may be similar in some ways to the disc 70 described in FIG. 4*a* and may define a fourth cutout in the form of a notch 478 and a fifth cutout in the form of a notch 480, and may rotate about a pin 476. The disc 470 may also form a first spoke 471 and a second spoke 473. Although not shown, the valve 410 may also include a substrate similar to that described in FIG. 4*c*.

When used in the exhaust breathing system 14, the valve 410 may be equipped in the housing 12 of FIG. 3 to regulate fluid-flow between the first outlet passage 60, the second outlet passage 62, and the third outlet passage 64. The disc 470 may rotate with respect to the associated substrate to align, partially align, or misalign the respective cutouts. This embodiment of the valve may perform similar operations to the embodiment described in FIG. 4*c*, so the operations will not be repeated here.

Referring to FIGS. 2 and 3, one embodiment of the actuator 20 may be used to control and operate the valve 10. For the examples given, this may mean rotating the valve 10. The exact operation of the valve 10 may partly depend on the desired flow-rate to the particular exhaust breathing system components. The actuator 20 may come in various forms including electrical as shown, but also pneumatic, hydraulic, and the like. The actuator 20 may be located outside of the housing 12 as shown, or inside the housing 12 as part of the valve 10. A single actuator 20 may be used to operate the single valve 10, and may in turn be controlled by an electronic control unit (ECU) (not shown) of the vehicle. The ECU may control the actuator 20, and thus the valve 10, by a closed-loop control system using feedback control.

Another embodiment may include a method of operating the valve 10 to perform various functions in the exhaust breathing system 14. For example, using the housing 12 of FIG. 2 and the valve 10 of FIG. 4*a*, the disc 70 may be rotated to align the first cutout 72 and the fourth cutout 78, while misaligning the second cutout 74 and the fifth cutout 80. In this position of the valve 10, the second outlet passage 62 may be fully open and delivering fluid-flow to the turbine 36 without exhaust throttling, and the first outlet passage 60 may be closed with no metering fluid-flow to the EGR assembly 30. In another valve position, the first cutout 72 and the fourth cutout 78 may be aligned, while the second cutout 74 and the fifth cutout 80 may also be aligned or partially aligned. Here, the second outlet passage 62 may be fully open and delivering fluid-flow to the turbine 36 without exhaust throttling, and the first outlet passage 60 may also be fully open with metering fluid-flow to the EGR assembly 30 or partially close with metering fluid-flow to the EGR assembly 30. In another valve position, the first cutout 72 and the fourth cutout 78 may be partially aligned or misaligned, while the second cutout 74 and the fifth cutout 80 may be misaligned. Here, the second outlet passage 62 may be partially close and throttling fluid-flow to the turbine 36 may be occurring for engine braking, engine shut-off, or to achieve a desired engine exhaust back pressure, or the second outlet passage 62 may be closed and similar throttling may be occurring; and the first outlet passage 60 may be closed with no metering fluid-flow to the EGR assembly 30. Other functions may be possible.

Another embodiment may include a method of operating the valve 10 to perform various functions in the exhaust breathing system 14. For example, using the housing 12 of FIG. 3 and the valves of FIGS. 4*c*-4*e* (example of 4*c* described here), the disc 270 may be rotated to align the first cutout 272 and the fourth cutout 278, while misaligning the second cutout 274 and the fifth cutout 280, and while misaligning the third cutout 288 and the fourth cutout 278. In this position of the valve 210, the second outlet passage 62 may be fully open and delivering fluid-flow to the turbine 36 without exhaust throttling, the first outlet passage 60 may be closed with no metering fluid-flow to the EGR assembly 30, and the third outlet passage 64 may be closed with no fluid-flow to the turbine bypass 42. In another valve position, the first cutout 272 and the fourth cutout 278 may be aligned, while the second cutout 274 and the fifth cutout 280 may be partially aligned or aligned, and while the third cutout 288 and the fourth cutout 278 may be misaligned. Here, the second outlet passage 62 may be fully open and delivering fluid-flow to the turbine 36 without exhaust throttling, the first outlet passage 60 may be partially close with metering fluid-flow to the EGR assembly 30 or fully open with metering fluid-flow to the EGR assembly 30, and the third outlet passage 64 may be closed with no fluid-flow to the turbine bypass 42. In another valve position, the first cutout 272 and the fourth cutout 278 may be partially aligned or misaligned, while the second cutout 274 and the fifth cutout 280 may be misaligned, and while the third cutout 288 and the fourth cutout 278 may be partially aligned or misaligned. Here, the second outlet passage 62 may be partially close and throttling fluid-flow to the turbine 36 may be occurring for engine braking, engine shut-off, or to achieve a desired engine exhaust back pressure, or the second outlet passage 62 may be closed and similar throttling may be occurring; the first outlet passage 60 may be closed with no metering fluid-flow to the EGR assembly 30; and the third outlet passage 64 may be partially close with some fluid-flow to the turbine bypass 42, or closed with no fluid-flow to the turbine bypass 42. Other functions may be possible.

The above description of embodiments of the invention is merely exemplary in nature and, thus, variations thereof are not to be regarded as a departure from the spirit and scope of the invention.

What is claimed is:

1. A product comprising:

a housing (12) disposed in an internal combustion engine exhaust breathing system (14), the housing (12) defining an inlet passage (58) to receive fluid-flow, defining a first outlet passage (60) leading to a first exhaust breathing system component, defining a second outlet passage (62) leading to a second exhaust breathing system component, and defining a third outlet passage (64) leading to a third exhaust breathing system component;

a valve (10) disposed within the housing (12) to regulate fluid-flow through the housing (12) and between the first, second, and third outlet passages (60, 62, 64);

an actuator (20) to operate the valve (10) wherein the housing (12) comprises a built-in cooling passage (66) adjacent the valve (10) to cool the valve (10) wherein the cooling passages (66) are always open regardless of the valve (10) position.

2. A product as set forth in claim 1 wherein the inlet passage (58) leads from an exhaust manifold (16), the first exhaust breathing system component is an exhaust gas recirculation assembly (30), the second exhaust breathing system component is a turbine (36), and the third exhaust breathing system component is a turbine bypass (42).

3. A product as set forth in claim 2 wherein the inlet passage (58) is integral with the exhaust manifold (16).

4. A product as set forth in claim 2 wherein the first outlet passage (60) is integral with the exhaust gas recirculation assembly (30).

5. A product as set forth in claim 4 wherein the second outlet passage (62) is integral with the turbine (36).

6. A product as set forth in claim 1 wherein the actuator (20) operates the valve (10) to selectively concurrently partially close the first outlet passage (60) with respect to the inlet passage (58), fully open the second outlet passage (62) with respect to the inlet passage (58), and close the third outlet passage (64) with respect to the inlet passage (58).

7. A product as set forth in claim 1 wherein the actuator (20) operates the valve (10) to selectively concurrently close the first outlet passage (60) with respect to the inlet passage (58), fully open the second outlet passage (62) with respect to the inlet passage (58), and close the third outlet passage (64) with respect to the inlet passage (58).

8. A product as set forth in claim 1 wherein the actuator (20) operates the valve (10) to selectively concurrently close the first outlet passage (60) with respect to the inlet passage (58), close the second outlet passage (62) with respect to the inlet passage (58), and close the third outlet passage (64) with respect to the inlet passage (58).

9. A product as set forth in claim 1 wherein the actuator (20) is disposed inside the housing (12) adjacent the valve (10).

10. A product comprising:

a housing (12) disposed in an internal combustion engine exhaust breathing system (14), the housing (12) defining an inlet passage (58) to receive fluid-flow, defining a first outlet passage (60) leading to a first exhaust breathing system component, defining a second outlet passage (62) leading to a second exhaust breathing system component, and defining a third outlet passage (64) leading to a third exhaust breathing system component;

a valve (10) disposed within the housing (12) to regulate fluid-flow through the housing (12) and between the first, second, and third outlet passages (60, 62, 64); and an actuator (20) to operate the valve (10) wherein the actuator (20) operates the valve (10) to selectively i) concurrently fully open the first outlet passage (60) with respect to the inlet passage (58), fully open the second outlet passage (62) with respect to the inlet passage (58), and close the third outlet passage (64) with respect to the inlet passage (58); ii) concurrently partially close the first outlet passage (60) with respect to the inlet passage (58), fully open the second outlet passage (62) with respect to the inlet passage (58), and close the third outlet passage (64) with respect to the inlet passage (58); iii) concurrently close the first outlet passage (60) with respect to the inlet passage (58), fully open the second outlet passage (62) with respect to the inlet passage (58), and close the third outlet passage (64) with respect to the inlet passage (58); iv) concurrently close the first outlet passage (60) with respect to the inlet passage (58), partially close the second outlet passage (62) with respect to the inlet passage (58), and partially close the third outlet passage (64) with respect to the inlet passage (58); v) concurrently close the first outlet passage (60) with respect to the inlet passage (58), close the second outlet passage (62) with respect to the inlet passage (58), and fully open the third outlet passage (64) with respect to the inlet passage (58); and vi) concurrently close the first outlet passage (60) with respect to the inlet passage (58), close the second outlet passage (62) with respect to the inlet passage (58), and close the third outlet passage (64) with respect to the inlet passage (58).

11. A product as set forth in claim 10 wherein the valve (10) comprises a stationary substrate (68) fixed in the housing (12) and defining a first cutout (72), a second cutout (74), and a third cutout (288), and also comprises a disc (70) rotatable with respect to the substrate (68) and at least partially overlapping the substrate (68), the disc (70) defining a fourth cutout (78) and a fifth cutout (80), and wherein the disc (70) is rotated by the actuator (20) to align and misalign the respective cutouts and perform the various selective operations of the valve (10).

12. A product as set forth in claim 10 wherein a single actuator (20) operates a single valve (10) to perform the various operations.

13. A product as set forth in claim 10 wherein the valve (10) comprises a wall (68) formed in and an integral part in the housing (12) and defining a first cutout (72), a second cutout (74), and a third cutout (288), and also comprises a disc (70) rotatable with respect to the wall (68) and at least partially overlapping the wall (68), the disc (70) defining a fourth cutout (78) and a fifth cutout (80), and wherein the disc (70) is rotated by the actuator (20) to align and misalign the respective cutouts and perform the various selective operations of the valve (10).

14. A product comprising:

a housing (12) disposed in an internal combustion engine exhaust breathing system (14), the housing (12) defining an inlet passage (58) to receive fluid-flow, defining a first outlet passage (60) leading to a first exhaust breathing system component, defining a second outlet passage (62) leading to a second exhaust breathing system component, and defining a third outlet passage (64) leading to a third exhaust breathing system component;

a valve (10) disposed within the housing (12) to regulate fluid-flow through the housing (12) and between the first, second, and third outlet passages (60, 62, 64); and an actuator (20) rotatably connected to the valve to operate the valve (10) wherein the actuator (20) operates the valve (10) and wherein the valve is rotated by the actuator to selectively concurrently fully open the first outlet passage (60) with respect to the inlet passage (58), fully open the second outlet passage (62) with respect to the inlet passage (58), and close the third outlet passage (64) with respect to the inlet passage (58).

15. A product as set forth in claim 14 wherein the actuator is a hydraulic or pneumatic actuator.

16. A product as set forth in claim 14 wherein the actuator is in the housing.

17. A product as set forth in claim 14 further comprising a pin extending between the actuator and the valve.

18. A product as set forth in claim 14 wherein the actuator comprises a shaft.

19. A product as set forth in claim 14 wherein the actuator is the only actuator that operates the valve.

20. A product as set forth in claim 14 further comprising an electronic control unit constructed and arranged to control the actuator.

21. A product as set forth in claim 14 wherein the physical connection comprises a pin connected to the actuator and connected to the valve.

22. A product comprising:

a housing (12) disposed in an internal combustion engine exhaust breathing system (14), the housing (12) defining an inlet passage (58) to receive fluid-flow, defining a first outlet passage (60) leading to a first exhaust breathing system component, defining a second outlet passage (62) leading to a second exhaust breathing system component, and defining a third outlet passage (64) leading to a third exhaust breathing system component;

a valve (10) disposed within the housing (12) to regulate fluid-flow through the housing (12) and between the first, second, and third outlet passages (60, 62, 64); and an actuator (20) rotatably connected to the valve to operate the valve (10) wherein the valve is rotated by the actuator wherein the actuator (20) operates the valve (10) to selectively concurrently close the first outlet passage (60) with respect to the inlet passage (58), partially close the second outlet passage (62) with respect to the inlet passage (58), and partially close the third outlet passage (64) with respect to the inlet passage (58).

23. A product as set forth in claim 22 further comprising a pin extending between the actuator and the valve.

24. A product as set forth in claim 22 wherein the physical connection comprises a pin connected to the actuator and connected to the valve.

25. A product comprising:

an internal combustion engine exhaust breathing (14) system comprising an exhaust manifold (16), an exhaust gas recirculation assembly (30), a turbine (36), and a turbine bypass (42);

a housing (12) defining an inlet passage (58) leading directly from and receiving fluid-flow directly from the exhaust manifold (16), defining a first outlet passage (60) leading directly to and delivering fluid-flow directly to the exhaust gas recirculation assembly (30), defining a second outlet passage (62) leading directly to and delivering fluid-flow directly to the turbine (36), and defining a third outlet passage (64) leading directly to and delivering fluid-flow directly to the turbine bypass (42);

a valve (10) disposed within the housing (12) to regulate fluid-flow through the housing (12) and between the first, second, and third outlet passages (60, 62, 64); and an actuator (20) rotatably connected to the valve to operate the valve (10) wherein the actuator (20) operates the valve (10) and wherein the valve is rotated by the actuator to selectively concurrently close the first outlet passage (60) with respect to the inlet passage (58), close the second outlet passage (62) with respect to the inlet passage (58), and fully open the third outlet passage (64) with respect to the inlet passage (58).

26. A product as set forth in claim 25 further comprising a pin extending between the actuator and the valve.

27. A product as set forth in claim 25 wherein the actuator is a single actuator that operates the valve.

28. A product as set forth in claim 25 wherein the physical connection comprises a pin connected to the actuator and connected to the valve.

29. A product comprising:

a housing (12) constructed for use in an internal combustion engine exhaust breathing system (14), the housing (12) defining an inlet passage (58) to receive fluid-flow, a first outlet passage (60) to deliver fluid-flow, a second outlet passage (62) to deliver fluid-flow, and a third outlet passage (64) to deliver fluid-flow; and a valve (10) disposed within the housing (12) upstream the first, second, and third outlet passages (60, 62, 64), the valve (10) regulating fluid-flow between the inlet passage (58) and the first, second, and third outlet passages (60, 62, 64) wherein the valve (10) is operated to selectively i) concurrently fully open the first outlet passage (60) with respect to the inlet passage (58), fully open the second outlet passage (62) with respect to the inlet passage (58), and close the third outlet passage (64) with respect to the inlet passage (58); ii) concurrently partially close the first outlet passage (60) with respect to the inlet passage (58), fully open the second outlet passage (62) with respect to the inlet passage (58), and close the third outlet passage (64) with respect to the inlet passage (58); iii) concurrently close the first outlet passage (60) with respect to the inlet passage (58), fully open the second outlet passage (62) with respect to the inlet passage (58), and close the third outlet passage (64) with respect to the inlet passage (58); iv) concurrently close the first outlet passage (60) with respect to the inlet passage (58), partially close the second outlet passage (62) with respect to the inlet passage (58), and partially close the third outlet passage (64) with respect to the inlet passage (58); and v) concurrently close the first outlet passage (60) with respect to the inlet passage (58), close the second outlet passage (62) with respect to the inlet passage (58), and fully open the third outlet passage (64) with respect to the inlet passage (58).

30. A product as set forth in claim 29 wherein an actuator (20) operates the valve (10) to selectively concurrently partially close the first outlet passage (60) with respect to the inlet passage (58), fully open the second outlet passage (62) with respect to the inlet passage (58), and close the third outlet passage (64) with respect to the inlet passage (58).

31. A product as set forth in claim 29 wherein an actuator (20) operates the valve (10) to selectively concurrently close the first outlet passage (60) with respect to the inlet passage (58), fully open the second outlet passage (62) with respect to the inlet passage (58), and close the third outlet passage (64) with respect to the inlet passage (58).

32. A product as set forth in claim 29 wherein an actuator (20) operates the valve (10) to selectively concurrently close the first outlet passage (60) with respect to the inlet passage (58), close the second outlet passage (62) with respect to the inlet passage (58), and close the third outlet passage (64) with respect to the inlet passage (58).

33. A product as set forth in claim 29 further comprising an actuator (20) to operate the valve (10).

34. A product as set forth in claim 29 wherein the valve (10) comprises a stationary substrate (68) fixed in the housing (12) and defining a first cutout (72), a second cutout (74), and a third cutout (288), and also comprises a disc (70) rotatable with respect to the substrate (68) and at least partially overlapping the substrate (68), the disc (70) defining a fourth cutout (78) and a fifth cutout (80), and wherein the disc (70) is rotated to align and misalign the respective cutouts and thus regulate fluid-flow between the inlet passage (58) and the first, second, and third outlet passages (60, 62, 64).

35. A product as set forth in claim 29 wherein the valve (10) comprises a wall (68) formed in and an integral part in the housing (12) and defining a first cutout (72), a second cutout (74), and a third cutout (288), and also comprises a disc (70) rotatable with respect to the substrate (68) and at least partially overlapping the substrate (68), the disc (70) defining a fourth cutout (78) and a fifth cutout (80), and wherein the disc (70) is rotated to align and misalign the respective cutouts and thus regulate fluid-flow between the inlet passage (58) and the first, second, and third outlet passages (60, 62, 64).

36. A product comprising:

a housing (12) constructed for use in an internal combustion engine exhaust breathing system (14), the housing (12) defining an inlet passage (58) to receive fluid-flow, a first outlet passage (60) to deliver fluid-flow, a second outlet passage (62) to deliver fluid-flow, and a third outlet passage (64) to deliver fluid-flow; and a valve (10) disposed within the housing (12) upstream the first, second, and third outlet passages (60, 62, 64), the valve (10) regulating fluid-flow between the inlet passage (58) and the first, second, and third outlet passages (60, 62, 64) wherein an actuator (20) is physically connected to the valve and operates the valve (10) wherein the valve is rotated by the actuator to selectively concurrently fully open the first outlet passage (60) with respect to the inlet passage (58), fully open the second outlet passage (62) with respect to the inlet passage (58), and close the third outlet passage (64) with respect to the inlet passage (58).

37. A product as set forth in claim 36 further comprising a pin extending between the actuator and the valve.

38. A product as set forth in claim 36 wherein the physical connection comprises a pin connected to the actuator and connected to the valve.

39. A product comprising:

a housing (12) constructed for use in an internal combustion engine exhaust breathing system (14), the housing (12) defining an inlet passage (58) to receive fluid-flow, a first outlet passage (60) to deliver fluid-flow, a second outlet passage (62) to deliver fluid-flow, and a third outlet passage (64) to deliver fluid-flow; and a valve (10) disposed within the housing (12) upstream the first, second, and third outlet passages (60, 62, 64), the valve (10) regulating fluid-flow between the inlet passage (58) and the first, second, and third outlet passages (60, 62, 64) wherein an actuator (20) is rotatably connected to the valve and operates the valve (10) wherein the valve is rotated by the actuator to selectively concurrently close the first outlet passage (60) with respect to the inlet passage (58), partially close the second outlet passage (62) with respect to the inlet passage (58), and partially close the third outlet passage (64) with respect to the inlet passage (58).

40. A product as set forth in claim 39 further comprising a pin extending between the actuator and the valve.

41. A product as set forth in claim 39 wherein the physical connection comprises a pin connected to the actuator and connected to the valve.

42. A product comprising:

an internal combustion engine exhaust breathing (14) system comprising an exhaust manifold (16), an exhaust gas recirculation assembly (30), a turbine (36), and a turbine bypass (42);

a housing (12) defining an inlet passage (58) leading directly from and receiving fluid-flow directly from the exhaust manifold (16), defining a first outlet passage (60) leading directly to and delivering fluid-flow directly to the exhaust gas recirculation assembly (30), defining a second outlet passage (62) leading directly to and delivering fluid-flow directly to the turbine (36), and defining a third outlet passage (64) leading directly to and delivering fluid-flow directly to the turbine bypass (42); and a valve (10) disposed within the housing (12) upstream the first, second, and third outlet passages (60, 62, 64), the valve (10) regulating fluid-flow between the inlet passage (58) and the first, second, and third outlet passages (60, 62, 64) wherein an actuator (20) operates the valve (10) to selectively concurrently close the first outlet passage (60) with respect to the inlet passage (58), close the second outlet passage (62) with respect to the inlet passage (58), and fully open the third outlet passage (64) with respect to the inlet passage (58), and an electronic control unit constructed and arranged to control the actuator.

43. A product as set forth in claim 42 further comprising a pin extending between the actuator and the valve.

44. A product comprising:

an internal combustion engine exhaust breathing (14) system comprising an exhaust manifold (16), an exhaust gas recirculation assembly (30), a turbine (36), and a turbine bypass (42);

a housing (12) defining an inlet passage (58) leading directly from and receiving fluid-flow directly from the exhaust manifold (16), defining a first outlet passage (60) leading directly to and delivering fluid-flow directly to the exhaust gas recirculation assembly (30), defining a second outlet passage (62) leading directly to and delivering fluid-flow directly to the turbine (36), and defining a third outlet passage (64) leading directly to and delivering fluid-flow directly to the turbine bypass (42);

a valve (10) carried in the housing (12) between the inlet passage (58) and the first, second, and third outlet passages (60, 62, 64) to regulate fluid-flow therebetween; and an actuator (20) to operate the valve (10) wherein the valve (10) is operated to selectively i) concurrently fully open the first outlet passage (60) with respect to the inlet passage (58), fully open the second outlet passage (62) with respect to the inlet passage (58), and close the third outlet passage (64) with respect to the inlet passage (58); ii) concurrently partially close the first outlet passage (60) with respect to the inlet passage (58), fully open the second outlet passage (62) with respect to the inlet passage (58), and close the third outlet passage (64) with respect to the inlet passage (58); iii) concurrently close the first outlet passage (60) with respect to the inlet passage (58), fully open the second outlet passage (62) with respect to the inlet passage (58), and close the third outlet passage (64) with respect to the inlet passage (58); iv) concurrently close the first outlet passage (60) with respect to the inlet passage (58), partially close the second outlet passage (62) with respect to the inlet passage (58), and partially close the third outlet passage (64) with respect to the inlet passage (58); and v) concurrently close the first outlet passage (60) with respect to the inlet passage (58), close the second outlet passage (62) with respect to the inlet passage (58), and fully open the third outlet passage (64) with respect to the inlet passage (58).

45. A product as set forth in claim 44 wherein the valve (10) comprises a stationary substrate (68) fixed in the housing (12) and defining a first cutout (72), a second cutout (74), and a third cutout (288), and also comprises a disc (70) rotatable with respect to the substrate (68) and at least partially overlapping the substrate (68), the disc (70) defining a fourth cutout (78) and a fifth cutout (80), and wherein the disc (70) is rotated to align and misalign the respective cutouts and thus regulate fluid-flow between the inlet passage (58) and the first, second, and third outlet passages (60, 62, 64).

46. A product as set forth in claim 44 wherein a single actuator (20) operates a single valve (10) to perform the various operations.

47. A product as set forth in claim 44 wherein the housing (12) comprises a built-in cooling passage (66) adjacent the valve (10) to cool the valve (10) wherein the cooling passages (66) are always open regardless of the valve (10) position.

48. A product as set forth in claim 44 wherein the valve (10) comprises a wall (68) formed in and an integral part in the housing (12) and defining a first cutout (72), a second cutout (74), and a third cutout (288), and also comprises a disc (70) rotatable with respect to the substrate (68) and at least partially overlapping the substrate (68), the disc (70) defining a fourth cutout (78) and a fifth cutout (80), and wherein the disc (70) is rotated to align and misalign the respective cutouts and thus regulate fluid-flow between the inlet passage (58) and the first, second, and third outlet passages (60, 62, 64).

49. A product comprising:

a housing (12) constructed for use in an internal combustion engine exhaust breathing system (14), the housing (12) defining an inlet passage (58) to receive fluid-flow, a first outlet passage (60) to deliver fluid-flow, and a second outlet passage (62) to deliver fluid-flow; and a valve (10) disposed within the housing (12) upstream the first and second outlet passages (60, 62), the valve (10) regulating fluid-flow between the inlet passage (58) and the first and second outlet passages (60, 62), the valve (10) comprising a substrate (68) fixed in the housing (12), the substrate (68) defining a first cutout (72) and a second cutout (74), the valve (10) further comprising a disc (70) rotatable with respect to the substrate (68), the disc (70) defining a fourth cutout (78) and a fifth cutout (80), wherein the disc (70) is rotated to align and misalign the respective cutouts and thus regulate fluid-flow between the inlet passage (58) and the first and second outlet passages (60, 62) wherein the valve (10) is operated to selectively i) fully open the first outlet passage (60) with respect to the inlet passage (58), and concurrently fully open the second outlet passage (62) with respect to the inlet passage (58); ii) close the first outlet passage (60) with respect to the inlet passage (58), and concurrently fully open the second outlet passage (62) with respect to the inlet passage (58); iii) partially close the first outlet passage (60) with respect to the inlet passage (58), and concurrently fully open the second outlet passage (62) with respect to the inlet passage (58); iv) close the first outlet passage (60) with respect to the inlet passage (58), and concurrently close the second outlet passage (62) with respect to the inlet passage (58);

and v) close the first outlet passage (60) with respect to the inlet passage (58), and concurrently partially close the second outlet passage (62) with respect to the inlet passage (58).

50. A product as set forth in claim 49 further comprising an actuator (20) to operate the valve (10).

51. A product as set forth in claim 49 wherein the housing (12) comprises a built-in cooling passage (66) adjacent the valve (10) to cool the valve (10) wherein the cooling passages (66) are always open regardless of the valve (10) position.

52. A product comprising:

a housing (12) constructed for use in an internal combustion engine exhaust breathing system (14), the housing (12) defining an inlet passage (58) to receive fluid-flow, a second inlet passage to receive fluid-flow, and a first outlet passage (60) to deliver fluid-flow; and a valve (10) disposed within the housing (12) downstream the inlet passage (58) and the second inlet passage, the valve (10) regulating fluid-flow between the inlet passage (58) and the second inlet passage and the first outlet passage (60), the valve (10) comprising a substrate (68) fixed in the housing (12), the substrate (68) defining a first cutout (72) and a second cutout (74), the valve (10) further comprising a disc (70) rotatable with respect to the substrate (68), the disc (70) defining a fourth cutout (78) and fifth cutout (80), wherein the disc (70) is rotated to align and misalign the respective cutouts wherein the housing (12) comprises a built-in cooling passage (66) adjacent the valve (10) to cool the valve (10) wherein the cooling passages (66) are always open regardless of the valve (10) position.

53. A product as set forth in claim 52 further comprising an actuator (20) to operate the valve (10).

54. A product comprising:

a housing (12) constructed for use in an internal combustion engine exhaust breathing system (14), the housing (12) defining an inlet passage (58) to receive fluid-flow, a first outlet passage (60) to deliver fluid-flow, and a second outlet passage (62) to deliver fluid-flow; and a valve (10) disposed within the housing (12) upstream the first and second outlet passages (60, 62), the valve (10) regulating fluid-flow between the inlet passage (58) and the first and second outlet passages (60, 62), the valve (10) comprising a wall (68) formed in and an integral part in the housing (12), the substrate (68) defining a first cutout (72) and a second cutout (74), the valve (10) further comprising a disc (70) rotatable with respect to the wall (68), the disc (70) defining a fourth cutout (78) and a fifth cutout (80), wherein the disc (70) is rotated to align and misalign the respective cutouts and thus regulate fluid-flow between the inlet passage (58) and the first and second outlet passages (60, 62) wherein the housing (12) comprises a built-in cooling passage (66) adjacent the valve (10) to cool the valve (10) wherein the cooling passages (66) are always open regardless of the valve (10) position.

55. A product comprising:

a housing (12) disposed in an internal combustion engine exhaust breathing system (14), the housing (12) defining an inlet passage (58) to receive fluid-flow, defining a first outlet passage (60) leading to a first exhaust breathing system component, defining a second outlet passage (62) leading to a second exhaust breathing system component, and defining a third outlet passage (64) leading to a third exhaust breathing system component;

a valve (10) disposed within the housing (12) to regulate fluid-flow through the housing (12) and between the first, second, and third outlet passages (60, 62, 64); and an actuator (20) to operate the valve (10) wherein the actuator (20) operates the valve (10) to selectively i) concurrently fully open the first outlet passage (60) with respect to the inlet passage (58), fully open the second outlet passage (62) with respect to the inlet passage (58), and close the third outlet passage (64) with respect to the inlet passage (58); ii) concurrently partially close the first outlet passage (60) with respect to the inlet passage (58), fully open the second outlet passage (62) with respect to the inlet passage (58), and close the third outlet passage (64) with respect to the inlet passage (58); iii) concurrently close the first outlet passage (60) with respect to the inlet passage (58), fully open the second outlet passage (62) with respect to the inlet passage (58), and close the third outlet passage (64) with respect to the inlet passage (58); iv) concurrently close the first outlet passage (60) with respect to the inlet passage (58), partially close the second outlet passage (62) with respect to the inlet passage (58), and partially close the third outlet passage (64) with respect to the inlet passage (58); and v) concurrently close the first outlet passage (60) with respect to the inlet passage (58), close the second outlet passage (62) with respect to the inlet passage (58), and fully open the third outlet passage (64) with respect to the inlet passage (58).

* * * * *